United States Patent [19]

Kato et al.

[11] Patent Number: 4,697,121

[45] **Date of Patent: * Sep. 29, 1987**

[54] LOW-PRESSURE MERCURY VAPOR DISCHARGE LAMP

[75] Inventors: Yasuo Kato, Zama; Tetsuo Ono, Kokubunji; Yoshio Watanabe, Tokyo; Seiichi Murayama, Kokubunji; Shigeo Mikoshiba, Tokyo; Hiromitsu Matsuno, Hachioji, all of Japan

[73] Assignee: Hitachi, Ltd., Tokyo, Japan

[ * ] Notice: The portion of the term of this patent subsequent to Sep. 9, 2003 has been disclaimed.

[21] Appl. No.: 904,398

[22] Filed: Sep. 8, 1986

Related U.S. Application Data

[63] Continuation of Ser. No. 577,611, Feb. 6, 1984, Pat. No. 4,611,148.

[30] Foreign Application Priority Data

Feb. 21, 1983 [JP] Japan ..... 58-26168

[51] Int. Cl.[4] ..... H01J 17/44; H01J 61/54

[52] U.S. Cl. ..... 313/595; 313/600; 313/493; 313/25; 315/58; 315/60; 315/61; 315/240

[58] Field of Search ..... 313/595, 600, 493, 25; 315/58, 60, 63, 61, 240, 208, 56, 205, 207

[56] References Cited

U.S. PATENT DOCUMENTS

| | | | |
|---|---|---|---|
| 3,629,647 | 12/1971 | Lake | 315/207 |
| 3,657,600 | 4/1972 | Wiegand, Jr. | 313/600 |
| 3,775,641 | 11/1973 | Goldberg | 313/595 |
| 3,857,063 | 12/1974 | Major et al. | 315/207 |
| 4,199,708 | 4/1980 | Lauwerijessen et al. | 313/612 |
| 4,335,331 | 6/1982 | Watanabe et al. | 315/334 |
| 4,433,271 | 2/1984 | Inoue et al. | 315/63 |
| 4,499,406 | 2/1985 | Saburo | 315/60 |
| 4,500,812 | 2/1985 | Roche | 315/205 |
| 4,507,588 | 3/1985 | Asmussen et al. | 315/39 |
| 4,524,301 | 6/1985 | Cohen et al. | 313/493 |
| 4,611,148 | 9/1986 | Kato et al. | 313/600 |

*Primary Examiner*—Leo H. Boudreau
*Assistant Examiner*—Michael Razavi
*Attorney, Agent, or Firm*—Antonelli, Terry & Wands

[57] ABSTRACT

A low-pressure mercury vapor discharge lamp in which a rare gas and mercury are provided in an outer bulb, which in turn contains therein a plurality of bent inner tubes, each having an opening at an end and an electrode at the other end thereof. A starting probe is provided between the openings in the outer bulb. An operating circuit or starter is connected to the electrodes. Further, a starting probe circuit is connected to the starting probe to apply a high voltage to the starting probe at the time of ignition.

1 Claim, 3 Drawing Figures

LOW-PRESSURE MERCURY VAPOR DISCHARGE LAMP

This is a continuation of application Ser. No. 577,611 filed Feb. 6, 1984, now U.S. Pat. No. 4,611,148.

BACKGROUND OF THE INVENTION

The present invention relates to an improvement of a compact fluorescent lamp similar to an incandescent lamp in shape, or more in particular to an improvement of the discharge ignition characteristic of a fluorescent lamp comprising an outer bulb and a plurality of bent inner tubes forming a discharge path, each of the inner tubes having an opening at an end and an electrode provided at the other end thereof.

As an example of a compact fluorescent lamp of a shape similar to an incandescent lamp, an ordinary fluorescent lamp thinned and bent and housed together with an operating circuit or starter in an outer bulb of a shape similar to an incandescent lamp is in practical use.

In such a lamp, the temperature of the discharge tube generally is high, resulting in the vapor pressure of mercury being increased naturally. In order to maintain the vapor pressure of mercury at optimum condition, means such as providing amalgam in the tube have been taken in the bulb. Nevertheless, it is still difficult to produce a lamp of high output. An example of fluorescent lamps which are to some extent free from this problem is disclosed in U.S. Pat. No. 4,199,708. This fluorescent lamp comprises an outer bulb sealed in a gas tight manner, at least a pair of bent inner tubes, each of the inner tubes having an end opened into the outer bulb and the other end with an electrode, and a discharge path leading from the electrode of one inner tube through the opening thereof into the outer bulb, through the opening of the other inner tube to the electrode of the other inner tube. Although the temperature of the inner tubes of this fluorescent lamp is also high, the vapor pressure of mercury has an almost optimum value because the vapor pressure of mercury is dependent on the temperature of the coldest point of the outer bulb.

In this compact fluorescent lamp which comprises a plurality of inner tubes bent and housed in a comparatively small outer bulb, however, the inner tubes forming a discharge path are generally thin, resulting in an extremely high ignition voltage or starting voltage of the fluorescent lamp.

SUMMARY OF THE INVENTION

Accordingly, an object of the present invention is to provide a low-pressure mercury vapor discharge lamp which comprises an outer bulb and a plurality of inner tubes bent and housed in an outer bulb, each of the inner tube having an opening at an end and an electrode provided at the other end thereof, and being easy to be ignited.

According to one aspect of the present invention, there is provided a low-pressure mercury vapor discharge lamp comprising an outer bulb containing a rare gas and mercury, a plurality of bent inner tubes provided in the outer bulb, each having an opening at an end and an electrode provided at the other end thereof, starting probe disposed between the openings and inside of the outer bulb, an operating circuit or starter connected to the electrodes, and an starting probe circuit connected to the starting probe for applying a high voltage to the starting probe at the time of starting.

Owing to the above-mentioned characteristic construction of the mercury vapor discharge lamp of the present invention, a discharge is formed between the electrodes of the inner tubes through the starting probe at the time of starting, so that the lamp is very easily ignited, thereby providing a low-pressure mercury vapor discharge lamp having a superior ignition characteristic.

DESCRIPTION OF THE PREFERRED EMBODIMENTS

The general principle of the present invention will be first explained.

In a fluorescent lamp comprising an outer bulb in which a rare gas and mercury are provided, and a plurality of bent inner tubes contained in the outer bulb, each having an opening at an end and an electrode disposed at the other end thereof, an electrode is provided on the base of the outer bulb between the openings of the inner tubes. This newly introduced electrode is hereinafter referred to as a starting probe. The starting probe is supplied with a high voltage from a circuit called a starting probe circuit to form a subsidiary discharge between one of the electrodes and the starting probe. The current value of the subsidiary discharge after forming the main discharge, which may be zero, is desirably limited to one tenth or less of the current of the main discharge in order to reduce the power loss due to subsidiary discharge and prevent the lamp from going out after ignition. In other words, the starting probe circuit is required to generate a comparatively high voltage at the time of ignition, and to desirablly limit the starting probe current to the above-mentioned comparatively low value after the ignition. In this way, the starting probe is impressed with such a high voltage as to induce and form a discharge at the time of ignition, while after starting the discharge, the starting probe current is controlled to a comparatively low value as mentioned above, thus reducing the power loss and preventing the lamp from going out. As an alternative, the starting probe circuit may have such a function that during the ignition process, the starting probe and the electrode of an inner tube is shorted with each other to shorten the length of the discharge path, thus increasing the electric field intensity, and that once the discharge is started, the discharge path that has so far been shorted is opened and impressed with a voltage thereby to apply an equivalently high voltage between the starting probe and the electrode of the other inner tube. In this fashion, a subsidiary discharge is formed between the starting probe and the main electrode, so that electrons and ions are supplied to the main discharge path to facilitate discharge of the main discharge path. And by keeping the starting probe current flowing even after the discharge is started, it is possible to prevent the lamp from going out.

The present invention will now be explained with reference to embodiments.

Figure 1:
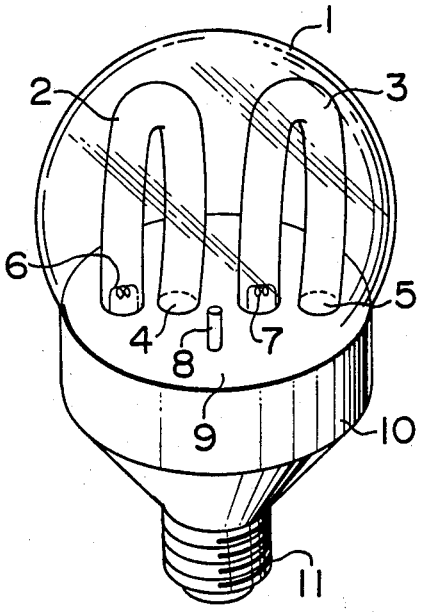
FIG. 1 is an outside view showing a general construction of a low-pressure mercury vapor discharge lamp according to the present invention.

The construction of a low-pressure mercury vapor discharge lamp according to the present invention is schematically shown in FIG. 1. In FIG. 1, reference numeral 1 designates an outer bulb evacuated and thereafter provided with mercury and a rare gas several Torrs in pressure. Numerals 2, 3 designate a pair of bent inner tubes, and numerals 4, 5 openings formed at an end of the inner tubes 2, 3, through which the interior of the inner tubes 2, 3 communicate with the interior of the outer bulb 1. Numerals 6, 7 designate electrodes provided at the other end of the inner tubes 2, 3, from which a discharge path is formed through the openings 4, 5 inside of the two inner tubes 2, 3.

Numeral 8 designates a starting probe featuring the present invention, which is supplied with a high voltage via a starting probe circuit connected to an operating circuit or starter at the time of discharge starts. Numeral 9 designates a base of the discharge tube, to which are fixed the inner tubes 2, 3, the electrodes 6, 7 and the starting probe 8. Numeral 10 designates a case for housing the operating circuit, and numeral 11 a base plug.

The discharge path of this fluorescent lamp starts from the electrode 6, and passing through the inner tube 2 and the opening 4 thereof out into the outer bulb 1, through the opening 5 into the inner tube 3, and ends at the electrode 7.

In this fluorescent lamp, the mercury vapor pressure of the discharge tube is determined not by the temperature of the inner tubes 2, 3 but by the temperature at the coldest point of the outer bulb 1 in contact with and cooled well by the atmosphere, and therefore even upon application of a comparatively large electric power, the mercury vapor pressure is maintained at a level proximate the optimum value thereof. Further, the problem found in the prior art in which the starting voltage is to be increased by the long discharge path is obviated by the fact that the starting probe 8 is provided substantially midway of the discharge path, that is, substantially intermediate the openings 4 and 5 of the inner tubes 2 and 3 and that the starting probe 8 is impressed with a high voltage directly or through a current limiter.

Figure 2:
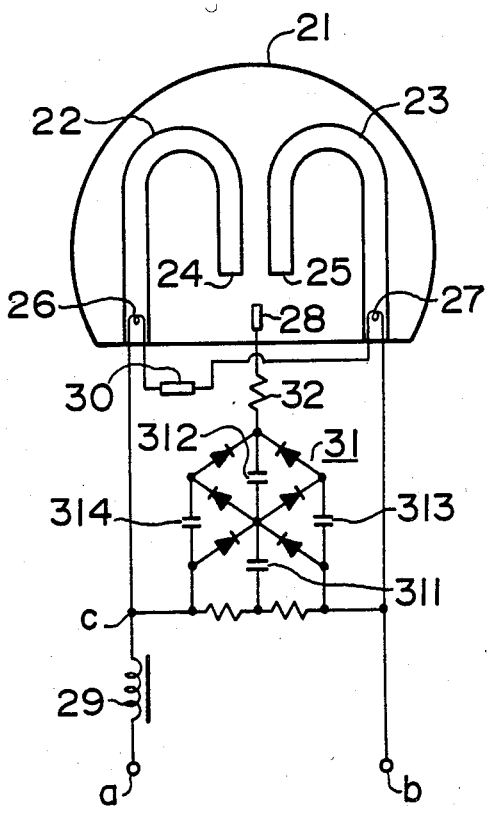
FIG. 2 is a diagram showing a construction of an embodiment of the present invention including an operating circuit.

A construction of an embodiment of the present invention including an operating circuit or starter is shown in FIG. 2. In FIG. 2, numeral 21 designates an outer bulb, numerals 22, 23 a pair of bent inner tubes, numerals 24, 25 openings of the inner tubes 22, 23, numerals 26, 27 electrodes, numeral 28 a starting probe. The starting probe 28 is supplied with a high voltage from the starting probe circuit 31 through a resistor 32 making up a current limiter. Numeral 29 designates a ballast made up of a choke coil, and numeral 30 a globottle starting switch for shorting the electrodes 26 and 27 at the time of starting. In this embodiment, a double-stage symmetrical Cockcroft Walton circuit is used as the starting probe circuit 31.

The operation of this circuit will be explained. Upon application of an AC source voltage between the input terminals a and b at the time of starting, the globottle starting switch 30 is closed, so that current flows through a choke coil 29, a filament 26, a globottle starting switch 30 and a filament 27, thus preheating the two filaments 26 and 27. And energy is stored in the choke coil 29. The high voltage to be applied to the starting probe 28 is generated by the symmetrical Cockcroft Walton circuit 31. Capacitors 311 to 314 of the circuit 31 are charged by the AC voltage applied between the terminals b and c, the capacitor 311 being charged to one half of the peak voltage between the terminals b and c and the capacitors 312 to 314 up to the peak voltage between the terminals b and c.

As a result, a positive voltage about double the peak voltage between the terminals b and c is produced between the starting probe 28 and the terminals b or c, whichever is lower in potential. When the globottle starting switch 30 is opened, a high voltage is applied between the filaments 26 and 27 from the choke coil 29, so that the sum of the half of the voltage between the filaments 26 and 27 and the voltage between the capacitors 311 and 312 is applied between the starting probe 28 and the filament 26 or 27, whichever is lower in potential, thus starting discharge. Upon discharge of an inner tube, most of the applied voltage is impressed between the filament of the other inner tube and the starting probe 28, and thus the other inner tube also discharges rapidly. After subsequent transfer to the state of steady operation, the discharge of a small current determined by the current limiter 32 is maintained between the starting probe 28 and one of the filaments of lower potential, thereby preventing the lamp from going out.

For example, assuming that the fluorescent lamp has a tube voltage of 65 V, a main discharge current of 300 mA, the capacitance of 1 $\mu$F of the starting probe circuit 31, and a current limiting resistor 32 of 10 k$\Omega$, then a voltage of about 260 V is generated in the starting probe circuit 31 when the glow switch is opened, and at the steady operation state, the starting probe current of about 5 mA flows through the starting probe 28. According to the experimental results of such a lamp, it was indicated that the lamp was started in satisfactory manner, and a voltage of 120 Volts was measured, when there was applied no starting probe current, at which voltage the lamp went out, while, when the starting probe current of 5 mA was made to flow, the voltage was decreased to as low as 108 volts, thus preventing the lamp from going out.

Figure 3:
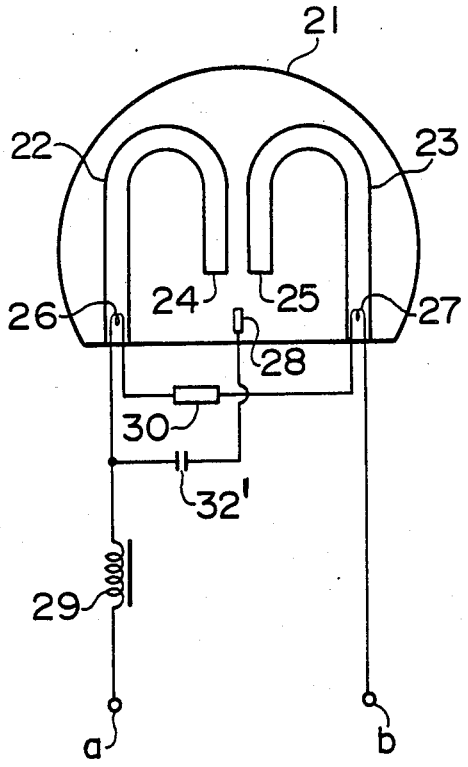
FIG. 3 is a diagram showing a construction of another embodiment of the present invention including an operating circuit.

The construction of another embodiment of the present invention including an operating circuit or starter is shown in FIG. 3. In FIG. 3, the same reference numerals as those in FIG. 2 are affixed to the component elements identical to those in FIG. 2. The starting probe 28 is connected to an end of the electrode 26 of the inner tube 22 through a capacitor 32' making up a starting probe circuit doubling as a current limiter. When a high voltage due to the choke coil 29 is applied between the electrodes 26 and 27 of the inner tubes 22 and 23 by the function of the globottle starting switch 30, the high voltage is applied through the capacitor 32' also between the starting probe 28 and the electrode 27 of the inner tube 23, with the result that discharge occurs first in the discharge path of the inner tube 23. Specifically, in the absence of the starting probe 28, the discharge paths of both the inner tube 22 and the inner tube 23 would be required to break down by discharge. Therefore, the discharge starting voltage is apparently reduced by the starting probe 28.

After the discharge of the inner tube 23, most of the voltage is applied between the electrode 26 of the inner tube 22 and the starting probe 28, and therefore the inner tube 22 also begins to discharge rapidly.

In the case where a capacitor 32' of 0.047 $\mu$F is connected, for example, the peak value of about 270 V of the applied voltage is required to start the fluorescent lamp, while the voltage of about 350 V would be required to be applied in the absence of the starting probe 28.

One feature of the circuit of the embodiment under consideration is that the high voltage generated by the choke coil 29 at the time of ignition is applied directly to the starting probe 28 through the capacitor 32' making up an starting probe circuit doubling as a current limiter.

In the aforementioned two embodiments, the operating circuit and the starting probe circuit may be positioned separately from the discharge tube. Further, three instead of two inner tubes may be provided. Furthermore, the position of the starting probe is not restricted to a point substantially midway between the openings of the inner tubes but may be located at any point between the openings of the inner tubes.

It should be understood from the foregoing description that according to the present invention, there is provided a low-pressure mercury vapor discharge lamp comprising an outer bulb, and a plurality of bent inner tubes each having an opening at an end thereof and an electrode housed at the other end thereof, the inner tubes being bent and sealed in the outer bulb, the discharge lamp further comprising a starting probe between the openings of the inner tubes and an starting probe circuit for applying a high voltage to the starting probe facilitate the ignition of the discharge lamp. Further, the starting probe is impressed with a high voltage through a current limiter, and then the starting probe current small as compared with the main discharge current is applied thereby to facilitate the ignition on the one hand and prevent the lamp from going out on the other hand.

We claim:

1. A low-pressure mercury vapor discharge lamp comprising an outer bulb gas-tightly enclosing a space filled with a rare gas and mercury, an inner tube arrangement disposed within the outer bulb, the inner tube arrangement being provided with an electrode at each of its two closed ends and the inner space of the inner tube arrangement communicating with the space enclosed by the outer bulb through an opening, a starting probe disposed in the proximity of the opening and inside of the outer bulb for establishing a subsidiary discharge path to each of the electrodes along a main discharge path which is formed between the electrodes, an operating circuit connected to the electrodes, and a starting probe circuit connected to the starting probe for applying a high voltage to the starting probe at the time of starting of the lamp.

* * * * *